United States Patent [19]

Phelps et al.

[11] Patent Number: 4,616,734

[45] Date of Patent: Oct. 14, 1986

[54] ROOF SCAFFOLDING

[75] Inventors: Philip Phelps, 1305 Eastern Dr., Urbana, Ill. 61801; Ricky Rose, St. Joseph, Ill.

[73] Assignee: Philip W. Phelps, Urbana, Ill.

[21] Appl. No.: 652,136

[22] Filed: Sep. 20, 1984

[51] Int. Cl.[4] ..... E04G 3/12

[52] U.S. Cl. ..... 182/45; 182/117; 182/121; 182/152; 182/206

[58] Field of Search ..... 182/45, 117, 121, 116, 182/119, 150, 152, 206; 248/235–238, 240, 240.1, 240.3, 240.4

[56] References Cited

U.S. PATENT DOCUMENTS

| | | | |
|---|---|---|---|
| 1,606,445 | 11/1926 | Pirsch | 182/206 |
| 1,921,310 | 8/1933 | Crisman | 248/285 |
| 2,359,869 | 10/1944 | Mick . | |
| 2,426,825 | 9/1947 | Geary . | |
| 3,083,835 | 4/1963 | Coralline | 248/460 |
| 3,231,043 | 1/1966 | Brown . | |
| 3,292,734 | 12/1966 | Swanberg | 182/45 |
| 3,491,852 | 1/1970 | Leist . | |
| 4,232,761 | 11/1980 | Phillips | 182/206 |

FOREIGN PATENT DOCUMENTS

| | | | |
|---|---|---|---|
| 540763 | 5/1957 | Canada | 182/45 |
| 2113285 | 8/1983 | United Kingdom | 182/45 |

*Primary Examiner*—Reinaldo P. Machado
*Assistant Examiner*—Alvin Chin-Shue
*Attorney, Agent, or Firm*—Marvin N. Benn; Milton S. Gerstein

[57] ABSTRACT

A firefighters' roof scaffolding is disclosed which is used by firefighters for standing upon the roof of a burning building in order to make a ventilation hole in the roof for ventilating the gases, and the like, from the interior of the building. The scaffolding has a cross beam of hollow construction, which mounts at one end a ladder attaching device to attach one end of the cross beam between two adjacent rungs of a conventional roof ladder suspended from the peak of the roof. The other end of the cross beam is provided with a roof attaching device for suspending that end from the roof itself. Each of the ladder attaching device and roof attaching device is secured to a respective end of the cross beam by a mounting block, which is juxtaposed adjacent a mounting plate positioned in the hollow interior of the respective end of the cross beam. A pivot pin interconnects the mounting plate and the mounting block, such that the end of the pivot pin is threaded for reception into a threaded central opening in the mounting block. The mounting block may, therefore, be rotated relative to its respective mounting plate along with the pivot pin, or may be rotated relative to both its respective mounting plate and pivot pin, so as to position the mounting block in one of two fixed, angular positions relative to the mounting plate: One position being for attachment purposes, and one position being for folding purposes. Cross braces is also mountable in two fixed transverse positions relative to the respective end of the cross beam, so that the cross beam may be attached to either of the two currently-used types of roof ladders, so as to position the cross beam below the peak of the roof the same distance regardless of which type of roof ladder is being used. The roof attaching device for the end of the cross beam is made up of two U-shaped channel members interconnected by a plurality of cross braces.

17 Claims, 18 Drawing Figures

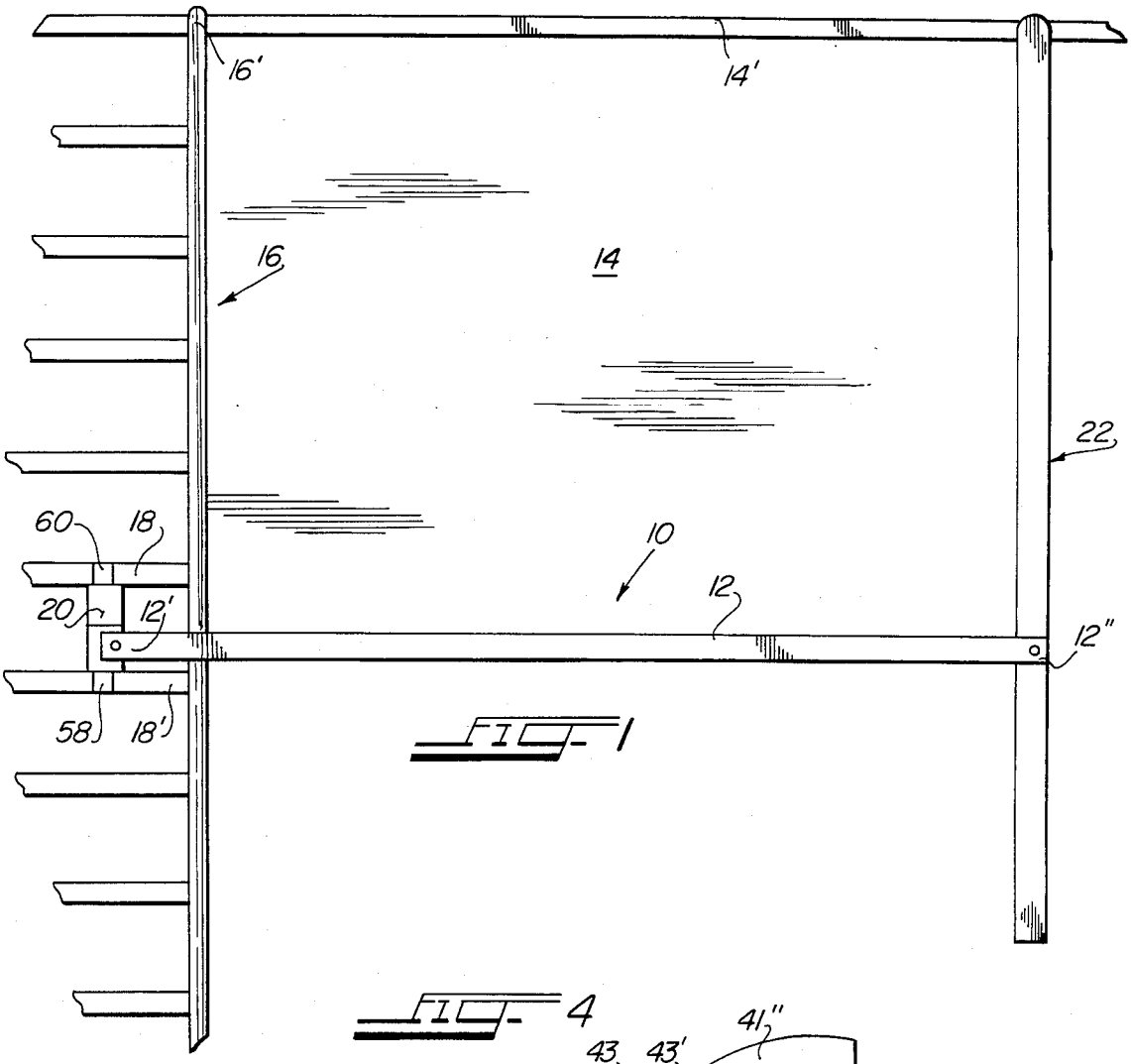
FIG. 1
FIG. 4
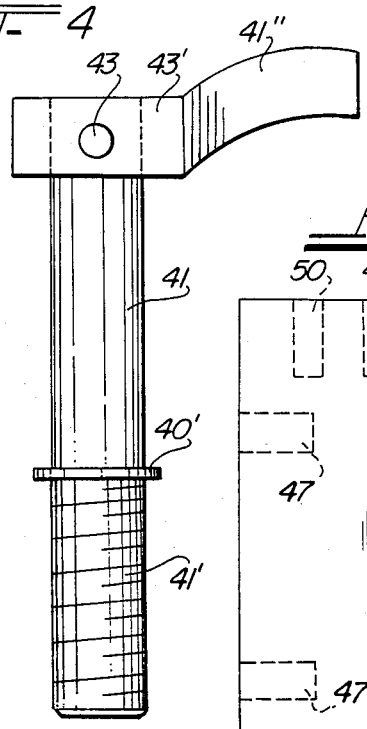
FIG. 8A
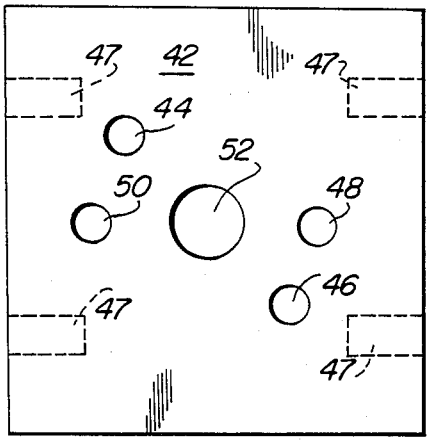
FIG. 8B
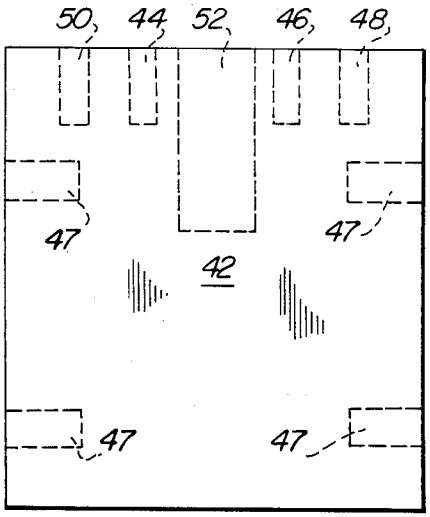

78
78'
78'
79

82
82'
83
83
86
86
85'
85
84'
84
78
94
92
94
94
86
80
22
82
86
86
86
86

56'
43'
43'
20
66
42'
44'
58
56
52'
48'
50'
46'
60
56'
43'
43'
74

78
86'
82
80
86'
86"
86
84
86"

20
43
68
74
72
72'
58
70
64
60
56'
43'
43
43'
66
62
60'
43

FIG. 6B
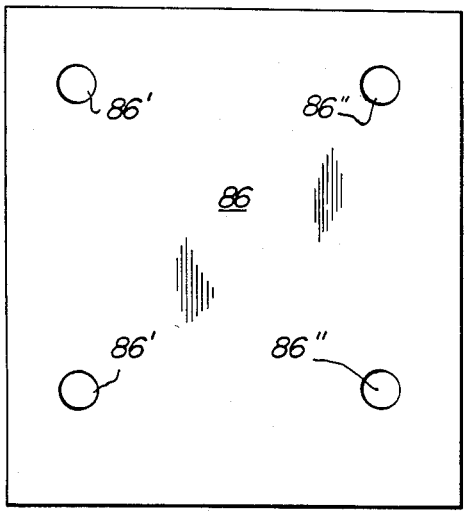
FIG. 6C
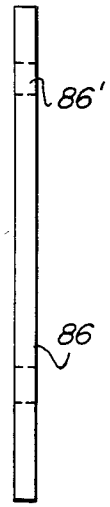
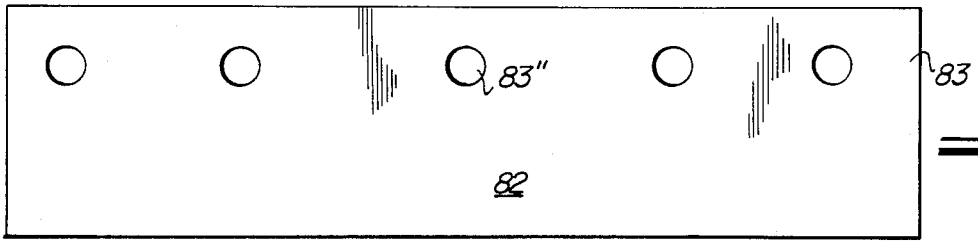
FIG. 7A
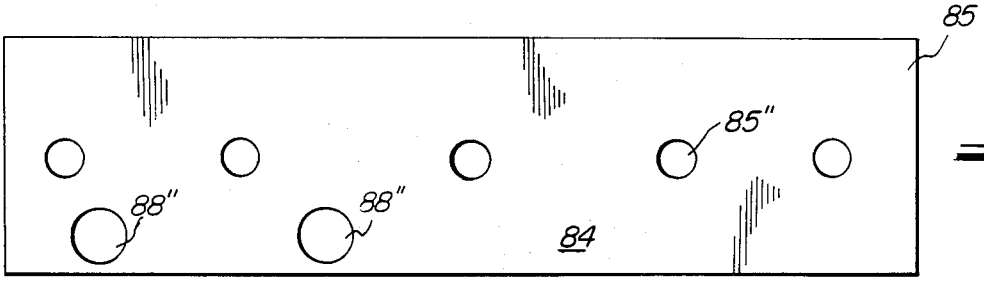
FIG. 7B
FIG. 3A
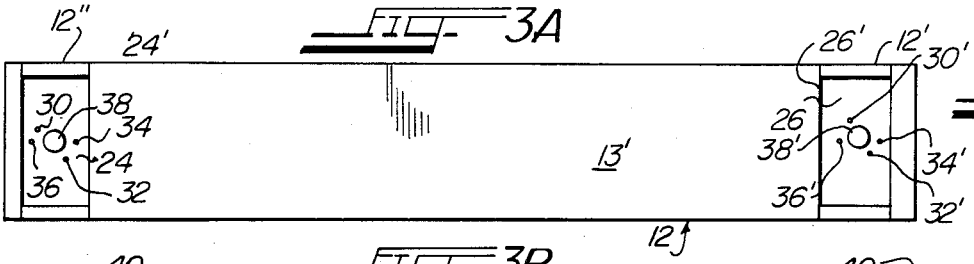
FIG. 3C
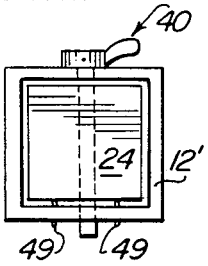
FIG. 3B
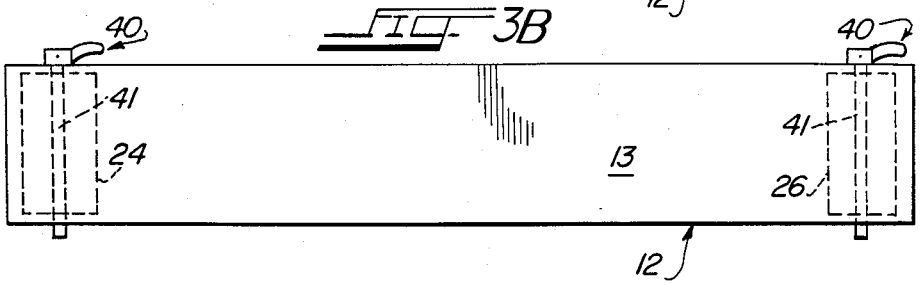

ROOF SCAFFOLDING

BACKGROUND OF THE INVENTION

The present invention is directed to a device for providing a support upon which a firefighter may stand, in order to form ventilation holes in the roof of a burning building. It is well-known that, in order to more effectively fight a fire, a square ventilation hole of approximately four feet by four feet is made in the roof. This hole is typically made by two firefighters, one utilizing an ax and the other a power saw.

Many roofs that require such ventilation holes are sloped at a steep angle, requiring that the firefighters work on the roof while standing upon ladders suspended from the peak of the roof, which ladders provide footing. This is not only dangerous, but also time-consuming. Further, the proper leverage and footing is ofttimes not attainable, thus resulting in improperly-formed ventilating holes. The time lost in preparing the holes necessary for the proper ventilation of the building may turn out to be critical, and may mean the difference between the saving of life and property, and the loss thereof. The danger caused by precarious footing may not only cause harm to the firefighter, but also may prevent the actual formation of the ventilation holes in the first place.

It would, therefore, be highly advantageous to provide a device that will allow the formation of these ventilation holes in the roofs of burning buildings in a safe, fast, and optimally-positioned manner, so that the holes made are of the right and effective size, while at the same time lessening the danger posed to the firefighters.

SUMMARY OF THE INVENTION

It is, therefore, the primary object of the present invention to provide a firefighter's roof scaffolding device that a firefighter may readily, easily, and safely carry with him to the roof of a burning building and set it up, so as to afford him, and other firefighters, safe footing and proper positioning for ample leverage in order to form a ventilation hole in the roof.

It is still another object of the present invention to allow for the scaffolding device of the present invention to be light in weight and foldable for carrying, to save the firefighters time and effort.

It is another object of the present invention to provide a firefighters' roof scaffolding that has a cross beam upon which the firefighter or firefighters may stand for forming the ventillation hole in the roof, which cross beam is readily and easily secured, at one end thereof, to a conventional roof ladder hung from the peak of the roof, and, at the other end thereof, to the peak of the roof itself at a portion thereof spaced from the portion from which the roof ladder is suspended.

It is, further, another object of the present invention to provide a firefighters' roof scaffolding device that is attachable to the two types of roof ladders presently used by firefighters for standing upon a sharply-sloped roof.

Toward these above ends, the firefighters' roof scaffolding device of the present invention is provided with a cross beam upon which firefighters stand during the formation of a ventilation hole in the roof of a burning building. At one end of the cross beam is a ladder attaching device having a first upper hook member for attachment to an upper rung of a conventional roof ladder suspended from the peak of the roof during firefighting, and a second lower hook member for attachment to a lower rung of the ladder. The ladder attaching device includes a main frame that is positionable in two locations to adapt the cross beam to the two types of roof ladders currently used by firefighters. The ladder attaching device is also provided with a mounting block that allows for the ladder attaching device to be oriented in two different angular positions relative to the end of the cross beam to which it is connected. Each angular position is fixable in place.

The other end of the cross beam mounts a roof attaching device which has a hook member for suspending the roof attaching device from the peak of the roof. The roof attaching device is also connected to the other end of the cross beam by a mounting block that allows for two angular positions thereof, one for attaching purposes, and one for folding purposes. The roof attaching device includes a pair of identical U-shaped channel members interconnected and tied together by a series of braces that extend the length of the channel members along the length of each leg thereof. The mounting block of the roof attaching device is connected to a mounting plate in the bottom surface of the cross brace, and is releasably connected to the mounting block by studs that prevent relative rotation between the mounting block and plate in the two fixed positions of the roof attaching device. The mounting block is also mounted for pivotal rotation, when changing from one fixed angular position to the other, by a pivot pin having a threaded end receivable in a threaded central hole of the mounting block. The pivot pin also extends through a central opening of the mounting plate at the end of the cross beam that mounts the roof attaching device.

The ladder attaching device is also provided with a similar mounting block, while the end of the cross beam that mounts the ladder attaching device is also provided with a similar mounting plate, to operate in the same manner as the mounting block and mounting plate for the roof attaching device.

BRIEF DESCRIPTION OF THE DRAWING

The invention will be more readily understood with reference to the accompanying drawing, wherein:

FIG. 1 is a plan view of the firefighters' roof scaffolding of the present invention;

FIG. 3A is a bottom view of the cross beam of the firefighters' roof scaffolding of the present invention showing the emplacement of the mounting plates at the ends of the cross beam;

FIG. 3B is a side view of the cross beam of FIG. 3A;

FIG. 3C is an end view of the cross beam of FIGS. 3A and 3B;

FIG. 4 is a detail, side view showing the replaceable connecting bolt at each end of the cross beam for connecting together the various parts of the firefighters' roof scaffolding of the present invention;

FIG. 6B is a plan view showing the cross brace for interconnecting the channel members of the support pole attaching means;

FIG. 6C is a side view of the cross brace of FIG. 6B;

FIG. 7A is a plan view showing the top channel member of the support pole attaching means;

FIG. 7B is a plan view showing the bottom channel member of the support pole attaching means;

FIG. 8A is a top plan view showing the mounting block for use with the support pole attaching means for connecting the end of the cross beam of FIG. 3A to the channel members of the support pole attaching means;

FIG. 8B is a side view of the mounting block of FIG. 8A; and

DETAILED DESCRIPTION OF THE INVENTION

Figures 2A, 2B, 5A, 5B, 6A, 9:
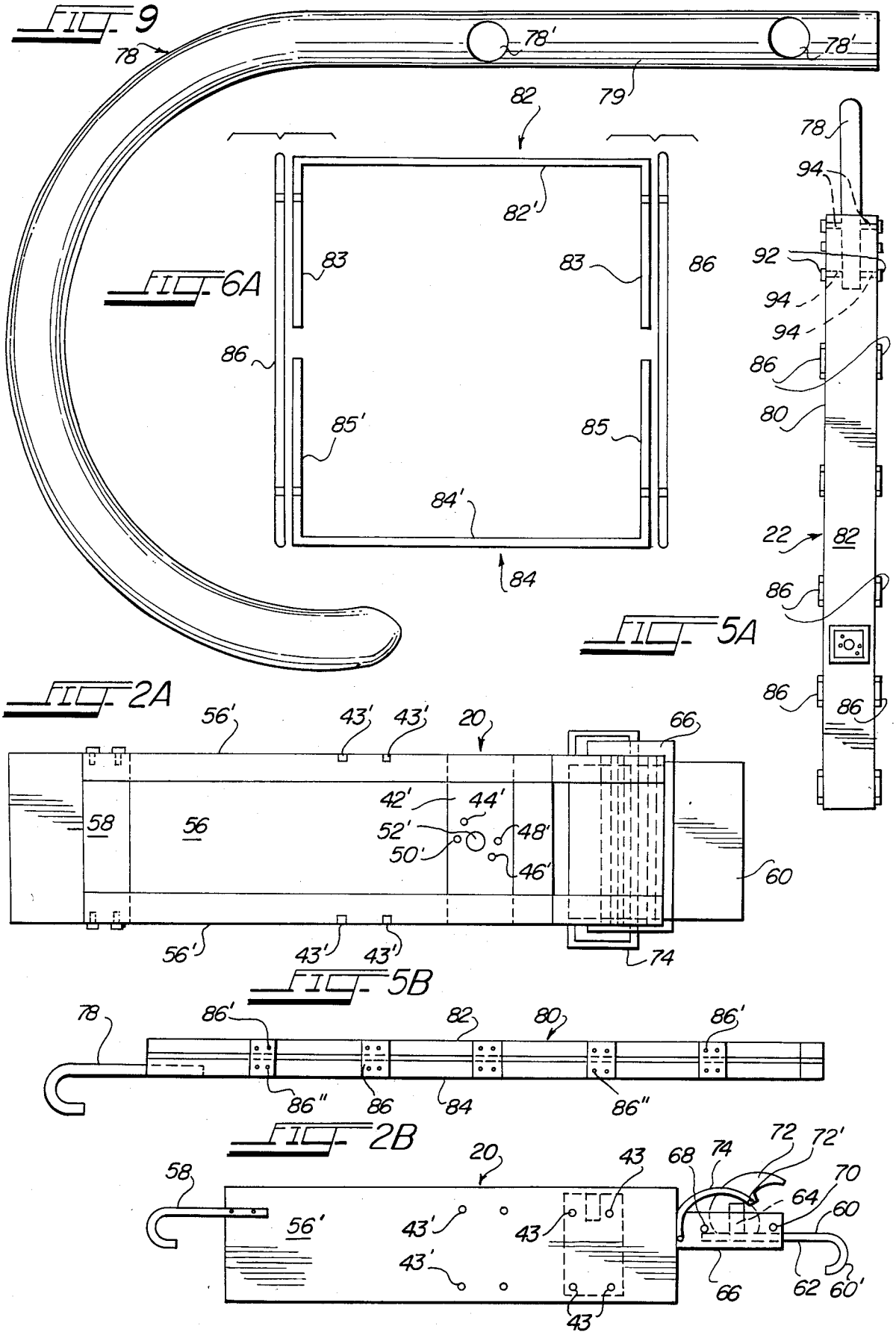
FIG. 2A is a detail plan view of the ladder-hook attaching means of the present invention positioned at a first end of a cross beam.
FIG. 2B is a side view of the ladder-hook attaching means of FIG. 2A.
FIG. 5A is a top plan view of the support pole attaching means of the present invention mountable to an end of the cross beam.
FIG. 5B is a side view of the support pole attaching means of FIG. 5A.
FIG. 6A is a detail assembly view showing the arrangement of connection of a cross brace with the channel members.
FIG. 9 is a plan view of the hook for the support pole attaching means used to attach the end of the cross beam to either the peak of a roof or to another ladder.
Figure 10:
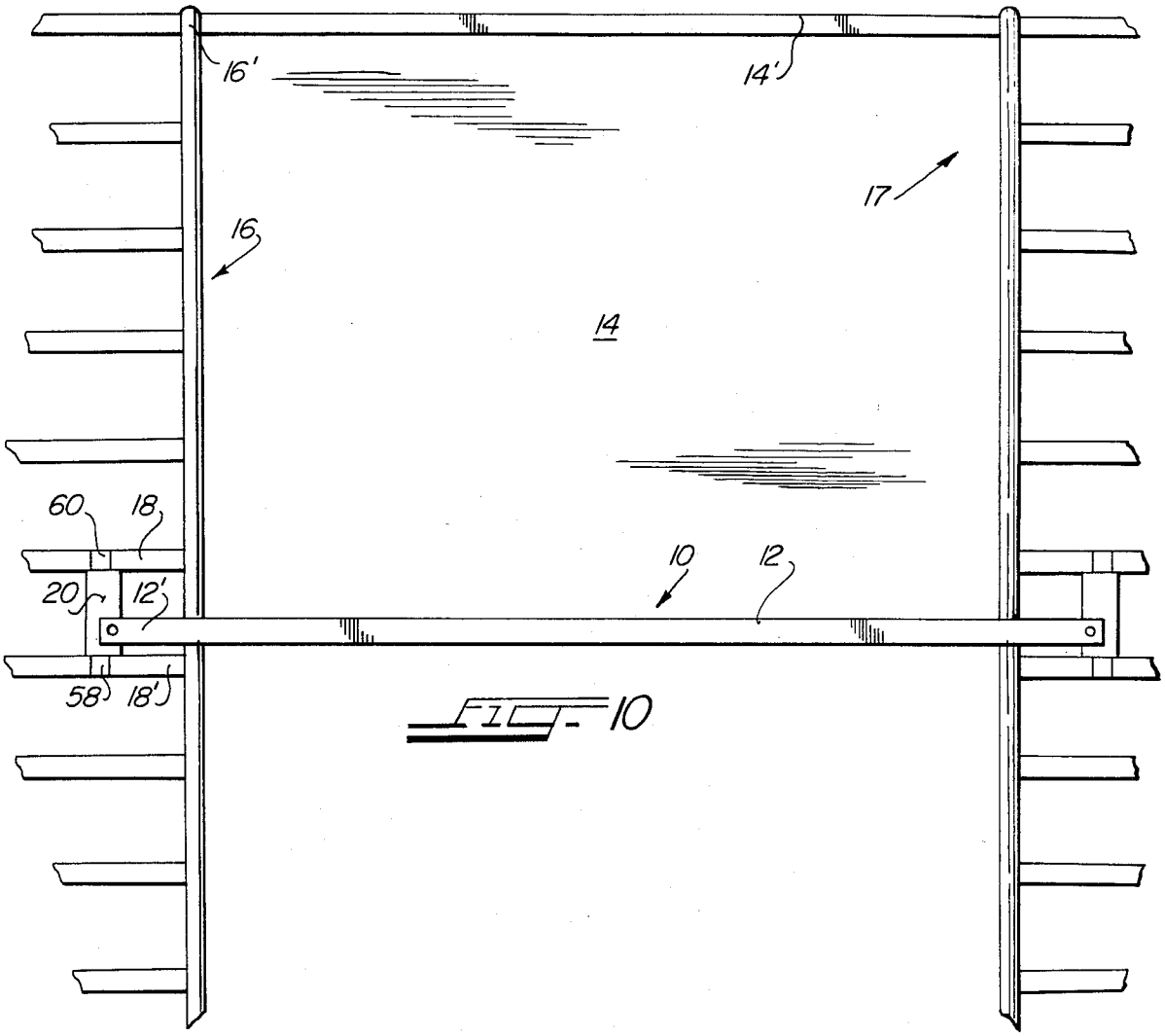
FIG. 10 showing the cross beam attached to two ladders.

Referring now to the drawing in greater detail, FIG. 1 shows the firefighters' roof scaffolding of the present invention for use in forming ventilation holes in the roofs of burning buildings, to help ventilate the smoke and gases in the interior of the building. The firefighters' roof scaffolding of the present invention is indicated generally by reference 10 in FIG. 1, and has a main cross beam 12 upon which a firefighter or firefighters stand for forming the ventilation hole in the roof 14, via an ax and/or power saw. The roof 14 of the burning building has a peak 14' which is used to attach a hook portion 16' of a conventional ladder 16, as shown in FIG. 1. The ladder 16 constitutes the presently-used device used in forming the ventilation holes in the roofs of burning buildings, upon which the firefighters support themselves and use the ax and power saw. The present invention's cross beam 12 is secured at a first end thereof to the ladder 16 between two adjacent rungs 18 and 18'. The end 12' of the cross beam that is attached to the ladder 16 is secured thereto by a ladder attaching device, indicated generally by reference numeral 20 in FIG. 1, which will be described in detail below.

The other end 12" of the cross beam 12 is mountable to a roof support pole attaching device 22, so that the cross beam 12 spans the space between the ladder 16 and the roof attaching device 22, thus providing firm footing for firefighters, to thereby quickly and safely form the hole necessary, as will be described in greater detail below. The roof attaching device 22 has a hook member at the top thereof for attachment to the peak of the roof, so that the end 12" of the cross brace hangs suspended from the peak 14', in a manner similar to the end 12'.

The ladder 16, that is presently used, generally comes in two basic designs: One where the top rung of the ladder is spaced a distance of approximately $19\frac{7}{8}$ inches from the peak of the roof when hung from the roof; and one where the top rung of the ladder is spaced 13 inches from the peak of the roof when hung from the roof. The overall length of each ladder is approximately 14 feet, with the only difference being that just mentioned: To wit, the portion of the length of the ladder at which the top rung of the ladder is positioned. Since the roof attaching means 22 of the present invention is of fixed length, to position the end 12" of the cross beam 12 the same distance below the peak 14' of the roof regardless of the ladder used, it is necessary to allow for the adjustment of the end 12' of the cross beam 12 so as to be adaptable to either of the two ladders used, to thus ensure that the end 12' extends perpendicularly to the ladder, and to ensure that the ends of the cross beam lie in the same plane parallel to the rungs of the ladder 16. The ladder attaching device 20 allows for this adjustment of the end 12' of the cross beam to accommodate both types of ladders used presently, the details thereof being described below.

The cross beam 12 is best seen in FIGS. 3A, 3B, and 3C. Each end 12' and 12" includes a mounting plate 24 and 26 of identical construction. Each mounting plate 24 and 26 is of generally rectangular cross-section.

The cross beam 12 is of hollow construction, and is generally of rectangular cross-section. Each end 12' and 12" of the cross beam is provided with a bottom cut-out portion, indicated generally by reference numerals 24' and 26', respectively, in FIG. 3A. Each of these bottom cut-out portions allows for the partial exposure of the bottom surfaces of the mounting plates 24 and 26, so that when these mounting plates 24 and 26 are mounted in the hollow interior of the cross beam, the diametrically-opposed holes 30, 32 and 34, 36 of the mounting plate 24, and the diametrically-opposed holes 30', 32' and 34',36' of the mounting plate 26 are accessible for connection to respective mounting blocks of the attaching devices, to be described below in greater detail. Each mounting plate 24 and 26 further has a central throughhole 38 and 38', respectively, which receives therethrough a pivot pin element 40, best seen in FIG. 4. Each pivot pin element 40 mounts a respective mounting block for pivotal rotation relative to a respective mounting plate.

FIGS. 8A and 8B show the construction of mounting block 42, for the roof attaching device 22. As shown in FIG. 8A, the mounting block 42 is also generally of rectangular cross-section and has a first pair of diametrically-opposed holes 44, 46 corresponding to holes 30, 32 of mounting plate 24, and diametrically-opposed holes 48, 50 corresponding to holes 34, 36 of mounting plate 24. The holes 44, 46, 48, and 50, like holes 30, 32, 34, 36, extend only part way into their respective elements. Mounting block 42 is of greater cross-sectional area than cut-out portion 24', so that mounting block 42 is positioned directly beneath bottom surface of the cross beam, and so that the mounting block is rotatable relative to mounting plate 24, so that mounting block 42 may be rotated to its two permanent positions, one for folding its respective attaching device, and one for positioning its respective attaching device for attachment. Mounting block 42 also has a threaded central aperture 52 for reception of a threaded end 41' of pivot pin shaft 41 of pivot pin element 40, so that it may be tightened to bring the mounting block 42 toward the bottom surface of the cross beam directly below mouting plate 24. A plurality of studs 49 are provided, which studs are inserted in the holes 44, 46, 48, and 50, at one ends of the studs, and inserted into the corresponding holes in respective mounting plate 24, at the other ends of the studs to thereby prevent relative rotation of the mounting plate and mounting block in either of the mounting block's two fixed positions. In the embodiment as shown in FIGS. 8A, 8B and FIGS. 3A–3C, where the diametrically-opposed holes of the mounting plate and mounting block are formed only partly through their respective elements, each stud 49 is first inserted at one end thereof into one of the holes of the mounting plate, and thereafter the other end of the stud is inserted into a corresponding hole of the mounting block by forcing the mounting block in a direction toward the mounting plate. In the position of the mounting block, when its respective attaching device is in a position to be attached to the peak of the roof, preferably each of the holes 44, 46, 48, and 50 has an end of a stud therein, with the other end of each stud is positioned, respectively, in the holes 30, 32, 34, 36. Thus, the mounting block is prevented from having any rotation relative to its respective mounting plate, to thus position the attaching device perpendicularly for attachment to the peak of the roof.

When it is desired to fold the attachment device at the end of the cross beam, as for carrying or storage purposes, the mounting block is rotated via handle 41'' until the holes 44 and 46 are aligned with the holes 34 and 36, so that the entire attaching device is rotated the same amount and in the same direction. The exact amount of rotation of the attachment device depends upon the arcuate spacing between the holes 44 and 50, so that the greater the distance therebetween, the greater will be the rotation of the mounting block and attachment device therewith. If it is desired to make each attachment device parallel with the length of the cross beam 12 during folding, then the holes 44 and 46 will be ninety degress removed from either of the holes 48 and 50. Coincidentally, of course, the holes 30 and 32 will be ninety degrees arcuately spaced from each of the holes 34 and 36. However, as shown in the Figures, the holes 44 and 46 are not spaced ninety degrees, so that upon rotation of the mounting block relative to its respective mounting plate, the attachment device will not be totally rotated ninety degrees, but at an angle less than that. This, however, is given only by way of example, and it is clear that any angle between zero and 90 degrees may be employed for folding purposes. When the mounting block is rotated to bring its respective attachment device into its folding, non-use position, there will be studs 49 present only in the holes 44 and 46, and in the holes 34 and 36 in the embodiment shown in the Figures. However, when the holes are spaced ninety degrees apart, then each hole will have an end of a stud therein, owing to the symmetry of the hole arrangement in each of the mounting block and mounting plate.

The mounting block 42 also has four pairs of apertures 47 which are used to attach the roof attaching device 22 thereto, as will be described in detail below.

The mounting plate 26 is also associated with a mounting block 42' shown in FIG. 2A. Mounting block 42' is of the same construction as mounting block 42, with the only exception being that mounting block 42' does not have the four pairs of apertures 47. The mounting blocks 42' operates in the same manner as mounting block 42, and is used to position the ladder attaching device 20 in either of two fixed angular positions: One for attachment of the cross beam to a roof ladder; the other for folding of the attachment device. The holes 44', 46', 48', 50' correspond with holes 30', 32', 34' and 36', respectively, of the mounting plate 26, and cooperate in the same manner as described above in reference to the mounting block 42 and the mounting plate 24.

Having described the structure of the cross beam and its interrelationship with the two attaching devices at its ends, the structure of each of these attaching devices will now be given. As explained above, the attaching device 20 must allow for use of the device of the present invention with either of the two basic types of roof ladders currently employed by firefighters. This will ensure that the cross beam will be spaced approximately 82 inches from the peak of the roof regardless of the type of ladder employed, this distance of the cross beam the peak of the roof having been found to be the optimal one for working conditions in forming the ventilation hole in the roof. The attaching device 20 is shown in FIGS. 2A and 2B, and includes a main frame 56 of hollow construction to make it lighter in weight, just as the cross beam itself is made of hollow construction for the same reason. At one end of the main frame 56, there is affixed a first hook member 58 for attachment to the lower rung of the ladder 16, as shown in FIG. 1. The hook member 58 is fixedly and non-movably attached to the end of the main frame 56, which frame 56 is provided with a second hook member 60 that is releasably locked in place upon the upper rung of the ladder. This hook member 60 has a hook 60' and an elongated shaft element 62, from which extends, in a perpendicular manner, an ear 64, the ear 64 being fixedly joined to the shaft element 62. The main frame 56 has projecting, at its end thereof, a bracket member 66 upon which are supported a pair of spaced-apart fixed stops 68, 70. These cylindrically-shaped stops 68 and 70 provide the limit to movement of the hook member 60 in the upward direction, as viewed in FIG. 2B. A lever member 72, also fixedly attached to the ear 64, as shown in FIG. 2B, has a slotted notch 72' in which is received a portion of the length of a biasing wire 74, which biasing wire 74 keeps the lever member 72 in either of two positions: The first position being the one shown in FIG. 2B, where the shaft element 62 abuts against the stops 68 and 70, which position is the open, unlocked position of the hook 60 and attaching device 20; and the second position being one where the shaft element 62 is placed from the stops 68 and 70, which is achieved upon pushing the lever member 72 downwardly as viewed in FIG. 2B, to thereby lock the hook 60' onto the upper rung, to thus lock the attaching device 20 in place upon the ladder 16. The locking and unlocking device, made up of the parts 62, 64, 66, 68, 70, 72 and 74, is well-known and conventional. Such a locking and unlocking mechanism is used in ladder bed-locks of aerial fire trucks. Clearly, other locking and unlocking means may be used instead of the one above-described.

The main frame 56, as shown in FIG. 2A, is provided with a rectangular cut-out section on the top surface thereof, so that the holes 44', 46', 48', 50' and 52' are exposed, so that studs 49 may be used to interconnect the mounting block 42' with the mounting plate 26, in the same manner as the mounting block 42 is connected to the mounting plate 24, such connection allowing for the relative rotation of the mounting block 42' relative to the mounting plate 26, as described above, to allow for the two possible fixed angular positions of the mounting block and related ladder-attaching device.

The mounting block 42' is positionable within the main frame 56 in two locations, so as to accommodate the two different types of ladders mentioned above. FIG. 2A shows the mounting block 42' positioned at one location for attachment to a first type of ladder having its top-most rung farther away from the peak of the roof when hung therefrom. This first location of the mounting block 42' is achieved through holes 43, four such holes being arranged in each side surface 56' of the main frame 56, as shown in FIG. 2B. Each of the two end surfaces of the mounting block 42' is provided with corresponding holes, so that screws may fasten the mounting block 42' in the first location by passing through respective holes in the side surface 56' and the respective end surface of the mounting block 42'. A second series of holes 43' are provided closer to the hook member 58, so that the mounting block 42' may be moved to a second location in the main frame 56, one which will accommodate the second type of ladder having its top-most rung closer to the peak of the roof when hung therefrom. Thus, the mounting block 43' may be positioned in either of the two locations to accommodate either of the two types of roof ladders currently employed by firefighters. Clearly, if there will be other types of ladders used in addition to the two types mentioned, then appropriate further series of holes may be made in the side surfaces 56' of the main frame 56 at locations therealong suitable to the spacing of the top-most rung of the ladder relative to the peak of the roof, so as to ensure that the two ends of the cross beam extend parallel to the peak of the roof.

Having described above the structure and interrelationships of the ladder attaching device 20, the structure and interrelationships of the roof attaching device 22 will now be given. FIGS. 5A and 5B show the roof attaching device 22 assembled as one whole and united unit, though it is actually made up of a few disconnectable members to be described directly. The roof attaching device has its own hook element 78, shown in detail in FIG. 9. The hook element 78 is used to attach the device to the peak of a roof, and is mounted to the upper portion of a supporting pole of the attaching device 22, indicated generally by reference numeral 80. The supporting pole or beam 80 consists of two similarly-shaped channel members 82 and 84, best seen in FIG. 6A, and FIGS. 7A and 7B. Each channel member has a U-shape, and has a base portion and a pair of spaced-apart, parallel leg portions extending perpendicularly from each side of the base portion, such leg portions being indicated by reference numerals 85 and 85' for channel member 84, and 83 and 83' for channel member 82, with the bases of the channel members being indicated by reference numerals 84' and 82', respectively. The channel members 82 and 84 are assembled together such that the legs 83 and 83' face toward and in substantially the same plane as the legs 85 and 85', respectively, as shown in FIG. 6A. The channel members are fastened together by a plurality of cross braces 86, one such cross brace being shown in FIGS. 6B and 6C. Each cross brace 86 has, preferably, two holes 86' and two holes 86'' arranged in quadrilateral fashion, as shown in FIG. 6B. Each hole 86' and 86'' is formed completely through the thickness of the cross brace, and these holes are used to tie the channel members together. The leg 83 is tied to the leg 85 by a series of these cross braces 86 overlapping portions of each leg, up and down the lengths of these legs, as shown in FIG. 5A. Each leg 83 and 85 is formed with a series of holes 83'' and 85'', respectively, which correspond with the holes 86' and 86'', respectively, for fastening the two legs 83 and 85 together, such that a small gap or space exists between the two edges of the legs facing each other, as shown in FIG. 5B. Similarly, the legs 83' and 85' are tied together by a series of cross braces 86, with the holes of the cross braces serving to tie together these legs in the same manner as the legs 83 and 85. The cross braces are fastened to the legs of the channel members preferably by pop-rivots, though any other well-known technique may be used.

Channel member 84 also has a pair of enlarged openings 88'' in each leg thereof, as shown in FIGS. 7B. These openings 88'' are used to mount the hook element, to be described below.

The mounting block 42 has eight holes 47, four of them lying in one plane parallel to the top face of the block as seen in FIG. 8A, for attachment by bolts to the upper channel member 82 via openings 83'', and four of them lying in another plane spaced from the first plane and parallel thereto for attachment via bolts to the bottom channel member 84 via its holes 85''. The top channel member 82 also has a substantially-rectangular cut-out portion formed in its base portion 82' through which the top face of the mounting block 42 is exposed, which face has the holes 44, 46, 48, 50 and 52, so that mounting block 42 may be juxtaposed adjacent the mounting plate 24 for attachment thereto via the studs 49 and the pivot bolt 41. Thus, the cut-out portion 24' of the end 12'' of the cross beam is aligned with the cut-out portion of the top channel member to allow interconnection of the mounting plate with the mounting block.

As can be seen in FIG. 8B, the hole 52, which receives the threaded end of the pivot bolt element 41, extends only partly through the thickness of the mounting block 42. To mount the mounting block 42 to the mounting plate 24, and to position the support pole 80 in its first fixed, attaching position, the studs 49 are first placed with their first ends inserted into the holes formed in the bottom surface of the mounting plate 24, so that their other ends project outwardly beyond the plane of the bottom surface of the cross beam. The mounting block 42, along with its associated support pole 80, is then positioned such that it lies parallel to the mounting plate and such that its central hole 52 is aligned with the central hole 38 of the mounting plate 24. Thereafter, the end 12'' of the cross beam is forced toward the mounting block 42 to force the other projecting ends of the studs 49 into the corresponding and aligned holes 44, 46, 48 and 50 to thus tie the mounting block 42 to the mounting plate 24 in fixed, non-rotatable fashion. Then the pivot pin element 40 is inserted through openings 38 and 52, such that the threaded end 41' of the shaft of the pivot pin is rotated into the central opening 52 of the mounting block, which central opening 52 is suitably threaded to receive the shaft end 41'. The pivot pin element 40 is rotated via gripping member 41'', as shown in FIG. 4, until the mounting block and mounting plate are tightly and securely fastened together. This establishes the roof attaching device with its support pole 80 and hook member 78 as an integral whole for attachment to the peak of the roof. After use, or when it is desired to fold the roof attaching device, as explained above, the pivot pin 40 is rotated relative to the mounting block, in the opposite direction, to free the mounting block 42 for subsequent partial conjoint rotation and movement until the holes 44 and 46 are aligned with the holes 34 and 36 of the mounting plate 24. Upon such alignment, the ends of the studs projecting from the bottom surface of the mounting plate 24 are forced into the holes 44 and 46 and the pivot pin 40 is then again rotated in the central hole 52 via its threaded end 41', to thus lock the roof attaching device in its folded position. To open up the roof attaching device from its folded position to its attaching position, the reverse is merely performed. Preferably, the holes 30, 32, 34, 36 are slightly smaller than the holes 44, 46, 48, 50, so that the studs 49 will remain in the mounting plate 24 whenever the mounting plate and the mounting block 42 are separated. Of course, it is possible to firmly affix these studs in their respective holes 30, 32, 34, 36, by any well-known means. Ensuring that the studs remain connected to the mounting plate, during separation of the mounting block from the mounting plate, will allow for easy and fast unfolding of the roof attaching device by a firefighter when he reaches the roof and prepares to form a ventilation hole therein. Since the firefighter will generally be carrying the scaffolding of the present invention in its folded position, where each attaching device is in its rotated position extending less than perpendicular from the end of the cross beam, it is necessary to make sure that as little time as possible is spent in opening up the attaching devices to their attaching positions. Thus, when the firefighter has climbed on the roof and is standing on the ladder 16 hung from the peak of the roof, as shown in FIG. 1, and while standing on a rung of the ladder, he simply rotates the pivot pin 40 at the end 12" to allow some separation between the mounting plate 24 and the mounting block 42, though still ensuring that the threaded end of the shaft 41' is still within the threaded opening 52 of the mounting block, by which separation the studs are forced free from the holes in the mounting block, whereupon the mounting block 42 may then be rotated along with the shaft 41 until the holes of the mounting block are aligned with the holes of the mounting plate in the position shown in FIG. 1, whereupon the pivot pin with the mounting block is raised slightly by handle 41" to force the ends of the studs at least partly into the holes 44, 46, 48, and 50 of the mounting block 42. Thereafter the shaft 41 is rotated to thus again tighten the shaft end 41' in the hole 52 of the mounting block. The very same procedure is carried out at the end 12' for the ladder attaching device 20, either by the same firefighter, or, to save time, by another firefighter, positioned below the first firefighter opening up the end 12" of the cross beam. After both attaching devices are arranged in their attaching positions, the firefighter or firefighters connect the attaching hook element 78 to the peak of the roof and, thereafter, connect the ladder attaching device 20 between two rungs of the ladder 16, which two rungs are readily determined by the fact that the roof attaching device 22 is first hung from the peak of the roof. This determination of the two rungs, to be used for attaching the ladder attaching device, is simple, after having hung the roof attaching device 22, since, after the roof attaching device has been hung, the cross beam 12 will extend at right angles thereto, so that the end 12' of the cross beam, still held by the firefighter on the ladder 16, may be readily positioned at those rungs of the ladder which make the cross beam 12 horizontal, so that the two ends 12' and 12" lie in the same horizontal plane.

While the end 12" of the cross beam 12 has been shown provided with a roof attaching device 22, it is to be understood that the roof attaching device itself may be replaced with another ladder attaching device 20, in those cases where there are two parallel-spaced roof ladders 16 utilized on the peak of the roof. In this case, the two ends of the cross beam 12 would be connected between the two-spaced apart ladders 16, by which it is allowed to have two firefighters work hand-in-hand to set up each end simultaneously. Alternatively, the roof attaching means itself could be used for attachment to a second roof ladder similar to ladder 16.

Referring to FIG. 4, the pivot pin element 40 is also provided with a pin 43. The pin 43 is fixedly secured to the cylindrical base portion 43' of the handle member 41". The pin 43 projects outwardly beyond a circumferential surface portion of the base portion 43, so that the end of the pin projecting outwardly may be inserted into a suitably-formed hole in the top portion of the shaft 41, which top portion is that part remote from the threaded end 41'. The pin fixedly and non-rotatably connects the handle member 41" to the shaft 41 to allow for the rotation of the shaft upon movement of its respective mounting block between its two fixed angular positions relative to its respective mounting plate. However, if too great a weight and/or force is applied to the end of the cross beam at which the pivot pin element 40 is mounted, thus breaking the shaft 41, it is a simple task to replace the broken shaft with a new one. This is simply accomplished by removing the handle member 41", with its base portion 43', by pulling out the pin 43 from the top portion of the shaft 41, and merely inserting the pin 43 with attached base 43' and handle member 41' into a new shaft, whereupon the new shaft is simply inserted through the appropriate respective central holes of the mounting plate and mounting block, in the manner described above. Each shaft 41 is also provided with a washer 40' which abuts the bottom surface of the respective mounting plate with which it is associated. The washer 40' spaces the mounting plate from its mounting block only a slight distance, with the washer 40' being of relative small diametric extension, so as not to interfere with the connections between the mounting plate and mounting block via the studs 49.

The hook element 78 of the roof attaching device 80 is secured to the bottom channel member 84 between its two legs 85 and 85'. This is accomplished by a pair of through-holes 78' being formed in the base portion 79 of the hook element 78, as shown in FIG. 9. A pair of bolts 92 are used to attach the hook element between the legs 85 and 85', by passing each bolt through a respective hole 78', and hole 88', and by providing two spacer elements for each bolt, one spacer element being positioned against one side of the hook element base 79 and extending to one of the legs of 85, 85' and abuting thereagainst, while the other spacer element is positioned against the other side of the base 79 and extends to the other leg 85, 85' and abuts thereagainst. These four spacers are indicated by reference numberals 94 in FIG. 5A. These spacers thus position the hook element 78 equidistant between the two legs 85, 85' of the bottom channel member 84, and allow for easy removal of the hook element and the replacement thereof.

When the entire firefighters' roof scaffolding of the present invention has been set up upon the roof of a burning building, in the manner as shown in FIG. 1, the firefighter or firefighters will stand on the upper edge surface 13, seen in FIG. 3B, so that the pivot pin element shafts 41 will experience transverse bending forces, necessitating the allowance of quick and easy replacement of any broken shaft 41, as described above. However, these bending moments are alleviated by the fact that the cross beam does not extend parallel to a horizontal plane, but extends perpendicular to the plane of the sloping roof, to which it is placed. Thus, the weight of the firefighter standing on the upper edge surface 13 is divided into two components, only one of which contributes to the bending moments above-mentioned, thus decreasing the chances of breakage of the shaft 41. This is even further militated against by the fact that the firefighter may stand with only one foot on the upper edge surface 13 and one foot actually placed on the roof itself.

It is, also, another feature of the present invention to ensure that the bottom surface 13' of the cross beam is spaced a certain distance from the plane of the sloping roof, so as to allow for the falling off of shingles, and the like, from the roof during the formation of the ventilation hole. A spacing $3\frac{3}{8}$ inches has been found to be effective for this purpose.

In one example of the present invention, all of the parts were made of aluminum. The cross beam was six feet in length. The support pole 22 was 8 feet in total length, with the pivot pin element shaft 41 at the end 12', which is attached to the roof attaching device, being positioned 82 inches below the top of the hook element 78, so as to give the preferred distance below the peak of the roof, mentioned above. The support beam or pole further was provided with two channel members each 3 inches wide, as measured from one leg to the other along the base portion 82' or 84', and $1\frac{1}{2}$ inches deep, as measured from the base portion 82' or 84' to the end of a leg. The holes 83'', 85'' were spaced along a respective leg every 2 inches, as measured from center to center. The gap between the two channel members 82 and 84 was $\frac{1}{4}$ of an inch. Each of the cross braces 86 were $3\frac{1}{8}$ inches in length, 3 inches in width, and $\frac{1}{8}$ of an inch in thickness. The spacing between the holes 86' was 2 inches, and the spacing between a hole 86' and an adjacent hole 86'' was 2 inches. The mounting block 42, as well as the mounting block 42', were each 3 inches deep, $2\frac{3}{4}$ inches in width, and $2\frac{3}{4}$ inches in length. The entire unit weighed only 30 pounds.

It is within the breadth and scope of the present invention to allow for the rotation of the mounting block between its two fixed angular positions by simple rotation of the pivot pin element 40 along with the mounting block together as a unit, without any relative rotation between the pivot pin and the mounting block at all. Toward this end, the mounting block is positioned on the threaded end 41' of the shaft 41 such that when the studs 49 do not interconnect the mounting block with its respective mounting plate, the cylindrical portion 43' rests upon the top surface 13'' of the cross beam, so that upon fixing the mounting block in either of its two fixed angular positions, the shaft 41, along with the mounting block is simply rotated as a unit until the corresponding holes of the mounting block and mounting plate are in alignment for interconnection by the studs 49, at which point the handle portion 41'' is gripped and pulled by the firefighter to bring the mounting block toward the mounting plate and to force the ends of the studs into the holes of the mounting block. To change the angular position of the mounting block, the handle portion 41'' is merely pushed toward the cross beam, to free the mounting block from connection with the studs 49, and to thus allow for relative rotation of the mounting block relative to the mounting plate, so that when the new angular position of the mounting block is achieved, the handle portion 41'' is again gripped and pulled by the firefighter to interconnect the mounting block with its mounting plate by the studs 49. This method of interlocking is fast and saves valuable time for the firefighter.

While specific embodiments of the invention have been shown and described, it is to be understood that numerous changes and modifications may be made therein without departing from the scope and spirit of the invention, as set out in the appended claims. It is, further, clear that each end of the cross beam 12 could be provided with ladder attaching device 20, so as to mount the cross beam between two parallel, spaced-apart roof ladders suspended from spaced portions of the peak of the roof.

What is claimed is:

1. A firefighters' roof of scaffolding for use in forming ventilating holes in the roof of a building, which roof has a peak, comprising:

a cross beam of sufficient width to permit at least one firefighter to stand thereon to form at least one ventilating opening in the roof of a building, said cross beam having a first end and a second end;

a first attaching means mounted to said first end of said cross beam for attaching said first end of said cross beam to a first ladder emplaced on the roof to be ventilated, which first ladder is attached to the roof from the peak thereof and extends downwardly toward the lower edge of the roof; said first attaching means comprising a first mounting block, and ladder-rung holding means which firmly grip at least one rung of the ladder to attach said first end of said cross beam to the ladder; and a second attaching means pivotally mounted to said second end of said cross beam for attaching said second end of said cross beam to one of a second ladder and a pole attached to the roof at a portion of the roof spaced from the portion at which the first ladder is hung, said second attaching means comprising a second mounting block mountable to said second end of said cross beam in a plurality of relative positions so as to be able to fold the scaffolding during non-use and during carrying, and to readily and easily open up the scaffolding for use, means mounting said second attaching means for rotational movement relative to said second end of said cross beam in a plane parallel to a longitudinal side of said cross beam, means for firmly holding said second mounting block in each of said plurality of relative positions, and means attachable to said second mounting block for connecting said second end of said cross beam to one of the second ladder and the pole attached to the portion of the roof spaced along the peak of the roof from the portion thereof to which is connected the first ladder.

2. The firefighters' roof scaffolding according to claim 1, wherein said first attaching means comprises means for mounting said first attaching means for rotational movement relative to said first end of said cross beam in a plane parallel to said longitudinal side of said cross beam so that said first attaching means may take on a plurality of positions relative to said first end of said cross beam, and means for firmly holding said first mounting block to said first end of said cross beam in each of said plurality of relative positions.

3. The firefighters' roof scaffolding according to claim 2, wherein said cross beam has a hollow interior so that it is light and easy for a firefighter to carry; said first end of said cross beam comprising a first mounting plate for secured attachment to said first mounting block, said first mounting plate of said first end of said cross beam being mounted in said hollow interior of said cross beam at said first end; and said second end of said cross beam comprising a second mounting plate for secured attachment to said second mounting block, said second mounting plate also being mounted in said hollow interior of said cross beam at the second end thereof.

4. The firefighters' roof scaffolding according to claim 3, wherein each of said first mounting block, said second mounting block, said first mounting plate, and said second mounting plate comprises a central opening; said first end and said second end of said cross beam each comprising a central through-hole for cooperation with respective one of said central openings; said means for mounting said first attaching means for pivotal movement and said means for mounting said second attaching means for pivotal movement each comprising pivot pin means for passage through a respective said central through-hole and respective ones of said central openings, so that said first mounting block may be pivoted relative to said first mounting plate, and said second mounting block may be pivoted relative to said second mounting plate.

5. The firefighters' roof scaffolding according to claim 4, wherein each of said first mounting block, said second mounting block, said first mounting plate, and said second mounting plate further comprises a first pair of diametrically-opposed holes lying on opposite sides of said central opening, said first pair of holes of each said mounting plate being capable of alignment with a respective first pair of holes of one of said first mounting block and said second mounting block, and each said means for holding comprising a plurality of plug elements for insertion in said first pairs of holes to firmly tie a respective mounting block to a respective mounting plate so as to prevent rotation of the mounting block, so that each of said first attaching means and said second attaching means is perpendicular to its respective end of said cross beam for subsequent attachment to the first ladder and one of the second ladder and a pole, respectively, so that the firefighter may use the scaffolding for ventilating the burning building.

6. The firefighters' roof scaffolding according to claim 5, wherein each of said first mounting block and said second mounting block further comprises a second pair of diametrically-opposed holes, whereby said plurality of plug elements of each of said means for holding may be inserted in said second pair of holes and connected to said first pair of holes of a respective mounting plate after pivoting the respective mounting block relative to its respective mounting plate in order to align said second pair of holes with said first pair of holes of a respective mounting plate, whereby the first and second attaching means may be folded inwardly for storage and carrying.

7. The firefighters' roof scaffolding according to claim 6, wherein said cross beam comprises a bottom surface which, when mounting the cross beam to the roof, faces toward the surface of the roof, said bottom surface having a first cut-out portion adjacent said first end of said cross beam, and a second cut-out portion adjacent said second end of said cross beam, said first mounting plate and said second mounting plate being located in the hollow interior of said cross beam directly adjacent said first cut-out portion and said second cut-out portion, respectively, with each said hole of said mounting plate facing toward said cut-out portion, whereby the holes of a respective mounting block may be aligned with and face toward the holes of a corresponding mounting plate.

8. The firefighters' roof scaffolding according to claim 1, wherein said first attaching means further comprises means mounting said first mounting block for movement to a plurality of vertical positions, comprising an elongated support member having a bottom surface that faces toward the first ladder when said first end of said cross beam is connected to the first ladder, a top surface having a substantially elongated cut-out portion, a first side edge surface, and a second side edge surface, an upper edge surface and a lower edge surface, each of said first and said second side edge surfaces having a plurality of holes formed therein for mounting said first mounting block at said plurality of positions; said first mounting block being mounted in said elongated support member between said first and second side edge surfaces; said first mounting block further having at least one opening on each of its side edge surfaces for cooperation with the plurality of holes on said side edge surfaces of said elongated support member, so that screws may interconnect aligned holes of said side edge surfaces of said elongated support member, so as to position said first mounting block at a desired position therealong.

9. The firefighters' roof scaffolding according to claim 8, wherein said ladder-rung holding means comprises a first hook member means for engagement with an upper rung of the first ladder, said hook member means being connected to said upper edge surface of said elongated support member, means for releasably locking said first hook member means to a rung of the first ladder; and a second hook member means fixedly connected to said lower edge surface of said elongated support member for engagement with a rung of the first ladder lower than the rung of the ladder to which said first hook member means is attached, whereby said first end of said cross beam is firmly held in place by the first ladder.

10. The firefighters' roof scaffolding according to claim 4, wherein said pivot pin means comprises a bolt having a shaft for passage through a respective said central through-hole of said cross beam, and a top wing portion for easy gripping by a hand, and a roll pin connecting said wing portion to the top portion of said shaft projecting beyond the top surface portion of said cross beam, said roll pin connecting said wing portion to said top portion of said shaft via aligned holes formed in said top surface of said shaft and in the body of said wing portion, whereby upon the breakage of the bolt shaft due to over-load conditions thereon, the broken shaft may be easily and readily removed from the cross beam and replaced by a new one by attaching said wing portion to the top portion of a new bolt shaft.

11. The firefighters' roof scaffolding according to claim 1, wherein said means attachable to said second mounting block comprises a support pole means, a hook means at the top of said support pole means, and means for mounting said hook means to the top of said support pole means; said support pole means comprising a first elongated channel member and a second elongated channel member, said channel members being spaced apart along the entire length thereof from one another; a plurality of braces for tying together said first channel member with said second channel member, each of said plurality of braces having a first overlapping portion that is connectable to said first channel member; and a second overlapping portion that is connectable to said second channel member, said plurality of braces being spaced apart along the length of said channel members;

each of said plurality of braces having a plurality of holes formed in each of said first overlapping portion and said second overlapping portion; and each channel member comprising a series of holes for cooperation with said holes of said overlapping portions of said braces, whereby said braces are fastenable to said channel members via respective aligned holes in said braces and channel members.

12. The firefighters' roof scaffolding according to claim 11, wherein said first channel member has a top surface that faces toward the bottom surface of said cross beam and toward said second mounting plate positioned in said second end of said cross beam, said top surface of said first channel member having a cut-out portion in which is positioned said second mounting block so that said second mounting block may be juxtaposed against said second mounting plate for attachment thereto; said second mounting block comprising a top surface portion that faces toward said bottom surface of said cross beam, and a first side edge surface and a second side edge surface, each of said first and second side edge surfaces comprising a first pair of holes spaced apart in a direction from said top surface of said mounting block toward the bottom surface of said mounting block, said first pair of holes being positioned adjacent one end of said mounting block, and a second pair of holes also spaced apart in a direction from said top surface of said mounting block toward said bottom surface, said second pair of holes being positioned adjacent the other end of said second mounting block, whereby the holes of both said side edge surfaces closer to the top surface of said second mounting block are connectable to said first channel member, and the holes of both of said side edge surfaces closer to the bottom surface of said second mounting block are connectable to said second channel member; each of said first and second channel members having corresponding through-openings for alignment with said plurality of holes, so that bolts may interconnect said channel members with said mounting block.

13. The firefighters' roof scaffolding according to claim 12, wherein each of said channel members is of U-shape cross-section having an elongated base portion, a first leg portion extending perpendicularly from one side edge surface of said base portion, and a second leg portion extending perpendicularly from the other side edge surface of said base portion in the same direction as said first leg portion; said channel members being connected together by said plurality of braces such that said base portion of said first channel member is parallel to said base portion of said second channel member and said first leg portion and said second leg portion of each channel member project toward the other channel member such that said first leg portions are in substantially the same plan, and said second leg portions are substantially in the same plane; said plurality of braces interconnecting said channel members by connecting said first leg portions of said channel members together, and connecting said second leg portions of said channel members together, whereby rigid structure is provided that is also light in weight.

14. The firefighters' roof scaffolding according to claim 13, wherein said hook means comprises a hook for attaching to a support and means for fixedly connecting said hook to the upper end portion of said second channel member; said means for fixedly connecting said hook comprising a plurality of bolts passing through holes formed in a lower portion of said hook, and a plurality of spacers each telescopingly receiving therethrough a bolt; said spacers spacing said hook between said first and second leg portions of said second channel member so that said hook is centered therein relative to said first and second leg portions of said second channel.

15. A scaffolding for use by firefighters, comprising:

a cross beam having a first end and a second end;

a mounting plate having a first central opening, and a first pair of diametrically-opposed holes lying on either side of said first central opening, said mounting plate being mounted in one of said first and second ends of said cross beam, said cross beam being hollow and having a bottom surface having a cut-out portion with which said mounting plate is juxtaposed such that said first central opening and said first pair of holes face toward said cut-out portion;

a mounting block of substantially the same cross sectional shape as said mounting plate for attachment thereto, said mounting block comprising a second central opening for alignment with said first central opening, a second pair of diametrically-opposed holes lying on opposite sides of said second central opening, and a third pair of diametrically-opposed holes lying on opposite sides of said second central opening, said third pair of holes lying in a plane at an angle relative to the plane in which are contained said second pair of holes, whereby by aligning said first pair of holes with said second pair of holes, one relative position between said mounting block and said mounting plate is assumed, and by aligning said third pair of holes with said first pair of holes, a second relative position is assumed;

means for pivotally connecting said mounting block to said mounting plate, said means for pivotally connecting passing through both of said first and second central openings, whereby the alignment of said first pair of holes with one of said second and third pair of holes is achieved; and means for firmly holding said mounting block to said mounting plate in at least one of its relative positions thereto, said means for holding comprising a plug means insertable in said first pair of holes and in at least one of said second and third pair of holes for firmly holding said mounting block in at least one of its relative positions;

said cross beam having a top surface having a through-opening for alignment with said first central opening of said mounting plate, whereby said means for pivotally connecting said mounting block to said mounting plate passes through said through-opening and through said first and second central openings of said mounting plate and said mounting block, respectively.

16. The scaffolding according to claim 15, in combination with a ladder-attaching means, said mounting block being fixedly connected to a portion of said ladder-attaching means so that said attaching means is movable with said mounting block to its positions relative to said mounting plate to assume relative positions.

17. A firefighters' roof scaffolding for use in forming ventilation holes in the roof of a building, which roof has a peak, comprising:

a cross beam of sufficient width to permit at least one firefighter to stand thereon to form at least one ventilation opening in the roof of a building, said cross beam having a first end and a second end;

a first attaching means mounted to said first end of said cross beam for attaching said first end of said cross beam to a first ladder emplaced on the roof to be ventilated, which first ladder is attached to the roof from the peak thereof and extends downwardly toward the lower edge of the roof; said first attaching means comprising a first mounting block, and ladder-rung holding means which firmly grip at least one rung of the ladder to attach said first end of said cross beam to the ladder;

a second attaching means mounted to said second end of said cross beam for attaching said second end of said cross beam to one of a second ladder and a pole attached to the roof at a portion of the roof spaced from the portion at which the first ladder is hung, said second attaching means comprising a second mounting block mountable to said second end of said cross beam in a pluraity of relative positions so as to be able to fold the scaffolding during non-use and during carrying, and to readily and easily open up the scaffolding for use, means mounting said second attaching means for pivotal movement relative to said second end of said cross beam, means for firmly holding said second mounting block in each of said plurality of relative positions, and means attachable to said second mounting block for connecting said second end of said cross beam to one of the second ladder and the pole attached to the portion of the roof spaced along the peak of the roof from the portion thereof to which is connected the first ladder;

said first attaching means comprising means for mounting said first attaching means for pivotal movement relative to said first end of said cross beam so that said first attaching means may take on a plurality of positions relative to said first end of said cross beam, and means for firmly holding said first mounting block to said first end of said cross beam in each of said plurality of relative positions;

said cross beam having a hollow interior so that it is light and easy for a firefighter to carry; said first end of said cross beam comprising a first mounting plate for secured attachment to said first mounting block, said first mounting plate of said first end of said cross beam being mounted in said hollow interior of said cross beam at said first end, and said second end of said cross beam comprising a second mounting plate for secured attachment to said second mounting block, said second mounting plate also being mounted in said hollow interior of said cross beam at the second end thereof.

* * * * *